United States Patent [19]

Taylor

[11] 4,267,818

[45] May 19, 1981

[54] DAMPER CONSTRUCTION

[75] Inventor: Edwin E. Taylor, New London, Iowa

[73] Assignee: Vega Industries, Inc., Des Moines, Iowa

[21] Appl. No.: 51,527

[22] Filed: Jun. 25, 1979

[51] Int. Cl.[3] ..... F24B 7/00

[52] U.S. Cl. ..... 126/121; 126/288

[58] Field of Search ..... 126/121, 122, 288, 285 R, 126/286, 290, 307 A; 251/298, 357, 368; 98/121 R, 121 A, 119

[56] References Cited

U.S. PATENT DOCUMENTS

| | | | |
|---|---|---|---|
| 2,846,935 | 8/1958 | Still | 98/119 |
| 3,473,559 | 10/1969 | Warren, Jr. | 98/119 |
| 4,184,475 | 1/1980 | Faehling et al. | 126/121 |

FOREIGN PATENT DOCUMENTS

| | | | |
|---|---|---|---|
| 161361 | 4/1921 | United Kingdom | 126/285 |

*Primary Examiner*—James C. Yeung

*Attorney, Agent, or Firm*—Zarley, McKee, Thomte, Voorhees & Sease

[57] ABSTRACT

A damper for movement between covering and uncovering positions with respect to a fireplace opening for draft control, includes a pair of rigid plates, one larger and one smaller in peripheral dimensions than the opening to be covered. These plates are carried loosely on a rod with a flexible disc, preferably of insulating material and of the same size as the larger rigid plate therebetween. The rod is movable either axially or pivotally to bring the flexible disc into and out of contact with the structure defining the opening through which draft is to be controlled.

14 Claims, 5 Drawing Figures

DAMPER CONSTRUCTION

BACKGROUND OF THE INVENTION

The present invention relates to draft control in heating appliances and, more specifically, to novel damper constructions movable to control draft through a fireplace opening.

Some form of draft control is necessary in stoves, furnaces, fireplaces and other heating appliances wherein a combustible fuel is burned. Damper constructions have been provided for movement into covering and uncovering positions with respect to the flue opening as well as openings through which combustion-supporting air is supplied to the firebox. Although the present invention may be utilized in either of the above-mentioned draft control applications and in virtually any type of combustion appliances, it is disclosed in connection with a fireplace of the prefabricated or factory-built type for controlling air flow into the firebox to support combustion.

The principal object of the invention is to provide a damper construction which is particularly effective in forming a substantially air-tight seal of an opening in spite of warping or other irregularities in the material defining or surrounding the opening.

In a more general sense, the object of the invention is to provide novel and improved draft control apparatus for use in a heating appliance.

Other objects will in part be obvious and will in part appear hereinafter.

SUMMARY OF THE INVENTION

The invention is embodied in a damper construction wherein three circular plates or discs are superimposed, but not physically attached, carried on a rod which passes loosely through a central opening in each disc. The two outer discs are of rigid sheet metal, one having a diameter smaller and the other larger than that of the opening to be covered. The center disc is somewhat flexible, being preferably formed from a sheet of asbestos or similar insulating, non-flammable material, and has a diameter equal to that of the larger rigid disc.

The rod upon which the discs are carried is movable either pivotally or axially to move the plates to covering and uncovering positions with respect to the opening through which draft is controlled. The rod is spring-biased toward the position wherein the opening is covered, with the smaller diameter rigid disc inside the opening and the flexible disc into sealing engagement with the structure defining the opening about the periphery thereof.

DETAILED DESCRIPTION OF THE INVENTION

Figure 1:
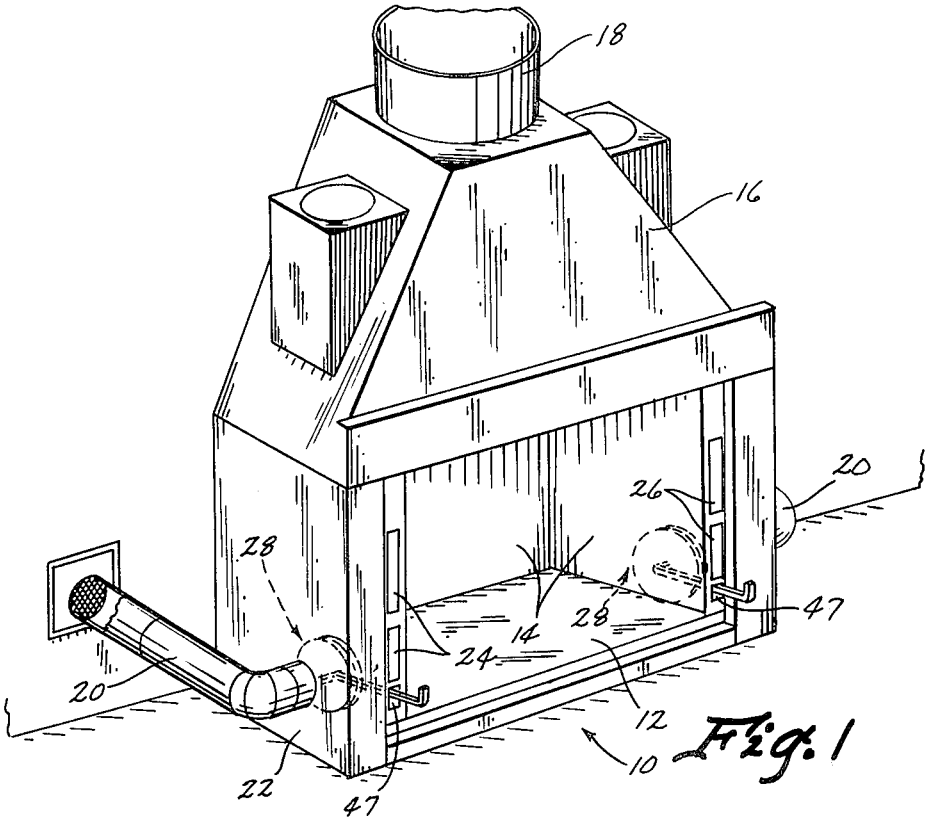
FIG. 1 is a perspective view of a fireplace wherein the damper construction of the invention is employed.

Referring now to the drawings, in FIG. 1 is shown a typical fireplace of the factory-built type, denoted generally by reference numeral 10, having the usual firebox defined by hearth floor 12 and side and rear walls 14. Smoke and other products of combustion rise from the firebox through hood structure 16 to chimney 18. In order to optimize heating efficiency, air to support combustion is drawn from a source outside the room or structure in which fireplace 10 is installed, rather than taking such air in directly through the frontal fireplace opening from the room to be heated. In the illustrated version, ducts 20 extend from open ends outside the house or other structure, through exterior fireplace walls 22 to discharge the outside air into a compartment 23 within the fireplace walls. The air may then pass through openings 24 and 26 and into the firebox. The structure is duplicated on each side of the fireplace, with the openings in fireplace walls 22 being selectively covered or uncovered by elements of the damper apparatus of the present invention, indicated generally in FIG. 1 by reference numeral 28.

Figure 2:
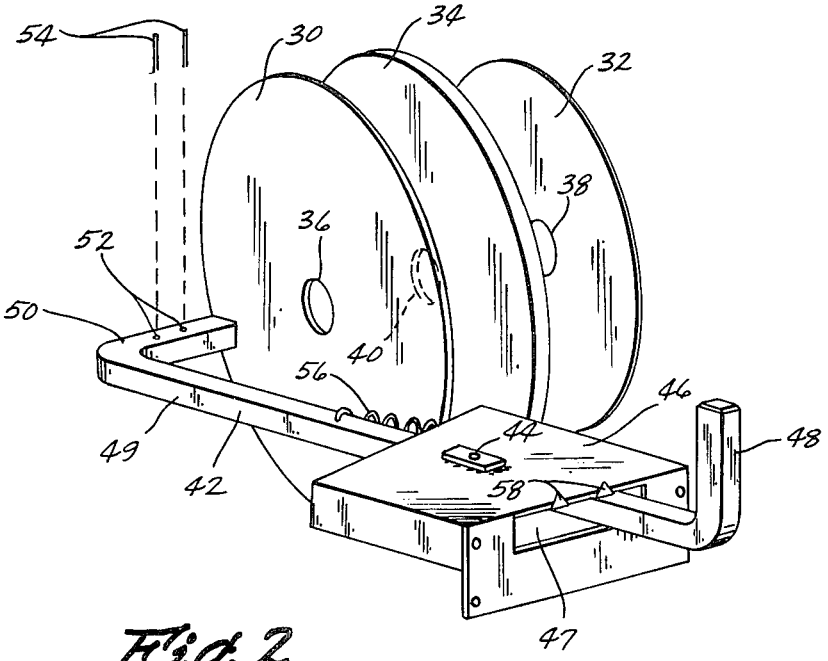
FIG. 2 is an enlarged, exploded perspective view of elements of the damper mechanism of the invention, shown in a first embodiment.
Figure 3:
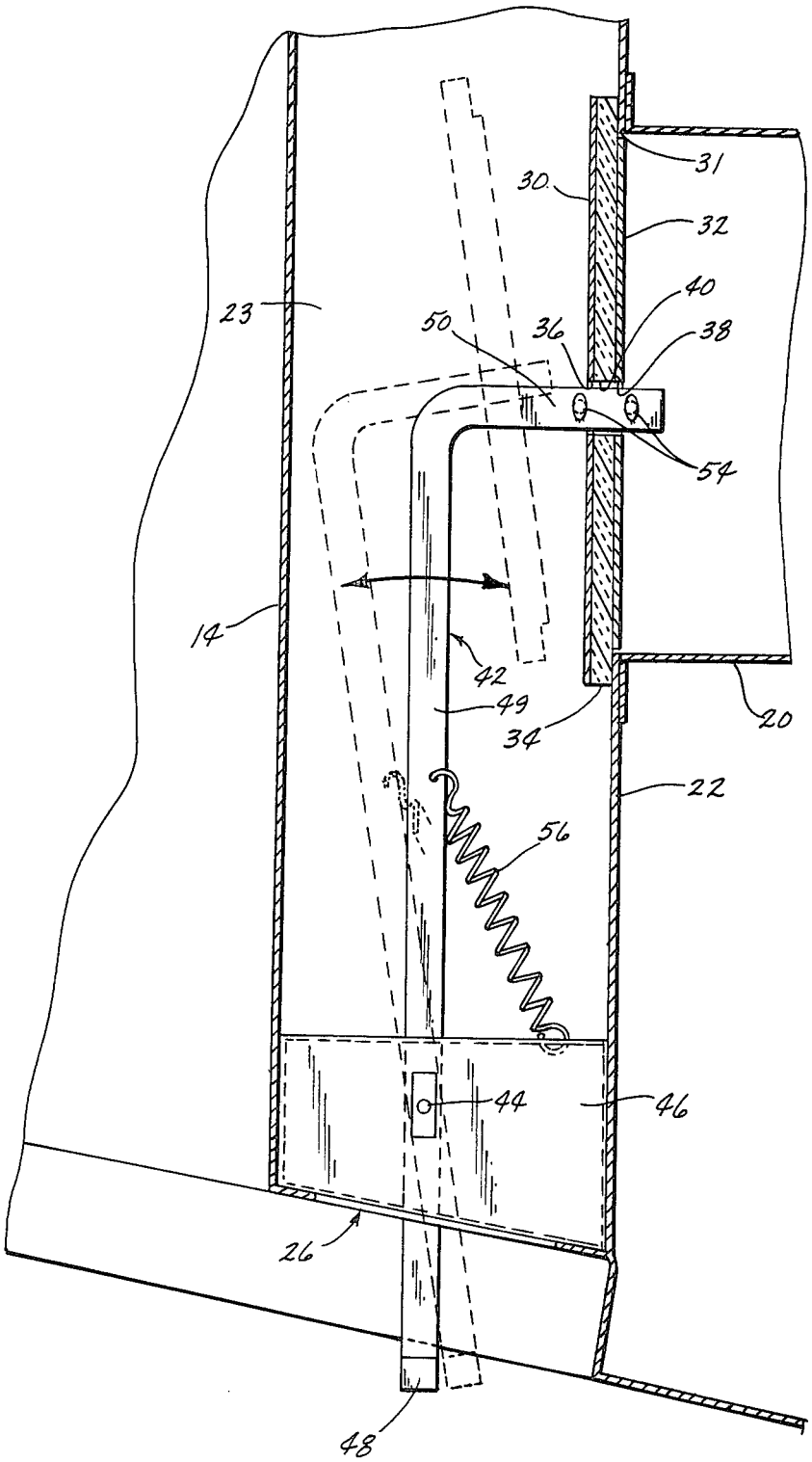
FIG. 3 is a fragmentary, plan view of the damper structure of FIG. 2 in horizontal section, showing the elements in two positions.

Turning now to FIGS. 2 and 3, the damper structure is shown in greater detail in a first embodiment. Rigid plate or disc 30 is of slightly larger diameter than the opening 31 in wall 22 through which air from duct 20 enters the fireplace. Rigid disc 32, on the other hand, is of slightly smaller diameter than the opening to be covered. A flexible disc 34 is of substantially the same diameter as large, rigid disc 30, and is made of flexible, fireproof material such as asbestos sheet or other insulating material. Discs 30, 32, and 34 each have a central opening 36, 38, and 40, respectively.

A mounting bracket 46 is affixed to a front wall portion of fireplace 10 by sheet metal screws, or similar means, and includes a rod opening 47 located immediately below opening 26 on the front of the fireplace. A rod 42 is pivotally mounted by a pin or screw 44 to mounting bracket 46 and includes an operating handle 48 protruding through opening 26. Handle 48 is bent at 90° with respect to a central portion 49 of rod 42. The opposite end of rod 42 is also bent at 90° to the central portion 49 to provide disc-carrying portion 50. Holes 52 are drilled through end portion 50 and are spaced by a distance slightly greater than the combined thickness of discs 30, 32 and 34. Also, the largest cross sectional dimension of end portion 50 is slightly smaller than the diameter of openings 36, 38 and 40, whereby the discs are carried somewhat loosely upon end portion 50 and retained between cotter pins 54.

A spring 56 is attached at one end to rod 42 and at the other to mounting bracket 46 to bias the rod toward clockwise movement about pin 44, as seen in FIG. 3. Detent means 58 on mounting bracket 46 releaseably retain rod 42 in a fully open or intermediate position, shown in dot-dash lines in FIG. 3. When the damper is in the fully closed position smaller diameter disc 32 is positioned within the opening in wall 22 through which duct 20 communicates with chamber 23 between inner and outer fireplace walls 14 and 22, respectively. Flexible disc 24 engages the inner surface of wall 22 about the periphery of the opening, being urged into contact therewith by larger diameter rigid disc 30 through the action of spring 56, rod 42 and cotter pin 54. Since the discs are carried somewhat loosely on rod end portion 50, as previously explained, allowing some freedom of movement or play between the rod and discs, the latter will conform to the plane of wall 22 surrounding the draft opening whether or not such plane is normal to the axis of rod end portion 50. That is, if the discs were rigidly affixed to or otherwise inflexibly carried by rod 42, the plane of the disc faces would be fixed with respect to the rod, which may not always be in exactly the same positional relationship to wall 22. Therefore, by mounting the discs in the manner described, and by making the disc which actually seals the opening of somewhat flexible, resilient material, a much more efficient seal is provided.

Figure 5:
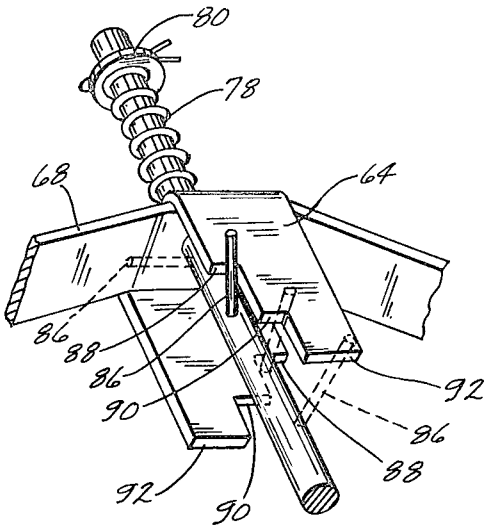
FIG. 5 is a fragmentary, perspective view of the embodiment of FIG. 4.
Figure 4:
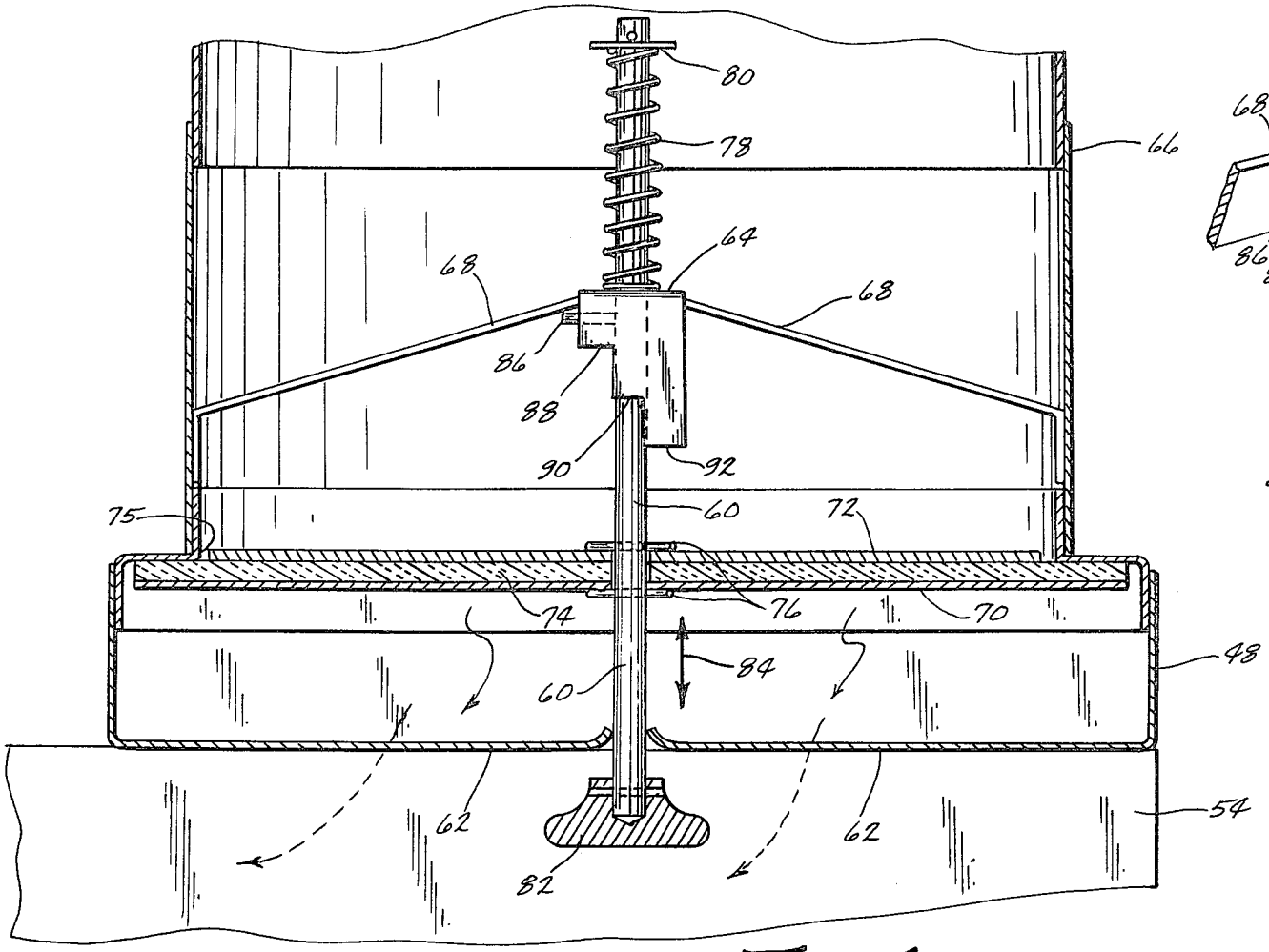
FIG. 4 is a plan view in horizontal section of a second embodiment of the invention.

The structure and operation of a second embodiment of the invention are shown in FIGS. 4 and 5. The damper structure of this embodiment is installed for axial movement of the operating rod and discs to move the discs into covering and uncovering relation to the end of a duct through which outside air is supplied for distribution through a manifold structure to support combustion in a fireplace.

An operating rod or shaft 60 extends slidably through openings in a front plate 62, and through a support member 64, held in stationary position within a duct 66 by support bracket 68. Rigid metal discs 70 and 72, of larger and smaller diameter, respectively, than the opening to be sealed, and resilient disc 74 are all carried upon rod 60, being retained somewhat loosely between a spaced apart pair of pins 76 thereon. Rod 60 is biased toward rearward movement, i.e., for engagement of resilient disc 74 with the periphery of the opening 75 by a spring 78 which is compressed between a washer 80 on rod 60 and support member 64.

The damper may be moved from the fully closed position shown in FIG. 4 to intermediate and fully open positions to allow outside air flow through the structure by manually pulling a handle 82 on the external end of rod 60, thereby moving rod 60 and the discs carried thereby axially, as indicated by arrow 84 in FIG. 4. The damper may be retained by the intermediate position by turning handle 82 and shaft 60 90° in either direction, after sufficient axial movement, so that a pin 86 which extends radially from rod 60 is engaged by one of surfaces 88 or 90 (FIG. 5) on support member 64. Rod 60 may be further moved and retained with the damper structure in the fully open position by rotation to engage pin 86 upon support member surface 92.

Thus, the damper structure of the invention provides a substantially air-tight seal, effective preventing the flow of air or other gases through an opening in a heating appliance when moved to a closed position with respect thereto. In the disclosed applications of the invention, the dampers are moved to the closed position when there is no fire in the fireplace in order to prevent outside air from flowing into the room wherein the fireplace is installed. As previously mentioned, due to the loose mounting of the discs and the resilience of the sealing disc, an effective seal is formed even though the opening to be sealed is not in a plane exactly normal to the axis of the operating rod upon which the discs are carried and the entire periphery of the opening may not be precisely planar. This allows wider manufacturing tolerances and, furthermore, insures integrity of the seal after installation and use which is particularly important in structures which are subject to relatively high heat and thus susceptible to warping or other dimensional changes.

Although the openings through which draft is controlled in the disclosed embodiments of the invention are circular, as is most commonly the case, the invention may be employed with openings of any configuration. The discs of the damper construction are preferably of the same external configuration as that of the opening through which draft is controlled, but in any case one of the rigid discs has a smaller external periphery, while the other rigid disc and the flexible disc have larger external peripheries than the draft opening.

What is claimed is:

1. A damper construction for controlling draft through an opening of predetermined peripheral dimensions in a heating appliance structure, said damper construction comprising, in combination:

(a) a first, rigid disc member having peripheral dimensions smaller than said predetermined dimensions;

(b) a second, rigid disc member having peripheral dimensions larger than said predetermined dimensions;

(c) a flexible disc member having peripheral dimensions larger than said predetermined dimensions;

(d) an operating rod passing through an opening in all three of said disc members to carry the latter in superposed relation in closely parallel planes with said flexible disc member between said first and second rigid disc members and wherein said apertures are of larger cross sectional dimension than the portion of said rod upon which said disc members are carried, whereby said disc members are loosely carried by said rod to allow radial variation in the relation of said superposed planes and the axis of said rod; and (e) means for mounting said rod for selective movement between a first position, wherein said first disc member is positioned within said opening and said flexible disc member contacts the structure defining said opening about the periphery thereof, and a second position, wherein all of said disc members are spaced from the structure defining said opening to allow gaseous flow therethrough.

2. The invention according to claim 1 wherein said flexible disc is constructed of an insulating material.

3. The invention according to claim 1 wherein the peripheral dimensions of said opening and all of said disc members are of the same configuration.

4. The invention according to claim 1, wherein all three of said disc members are retained on said operating rod by a pair of pins affixed to and extending radially from said rod on opposite sides of said parallel planes and wherein said pins are spaced by a distance slightly greater than the combined thickness of all of said disc members retained therebetween.

5. The invention according to claim 1 and further including spring means biasing said operating rod toward said first position.

6. The invention according to claim 1 wherein said operating rod is mounted for pivotal moverment between said first and second positions.

7. The invention according to claim 1 wherein said operating rod is mounted for axial movement between said first and second positions.

8. The invention according to claim 1 and further including spring means biasing said operating rod toward said first position, and detent means for selectively retaining said operating rod in said second position.

9. A fireplace structure having a damper construction for controlling draft through a portion thereof comprising:

(a) a wall portion surrounding an opening of fixed peripheral dimensions and configuration in the fireplace structure;

(b) first and second flat discs of the same configuration and smaller and larger peripheral dimensions, respectively, than said opening;

(c) a third flat disc of the same configuration and substantially the same peripheral dimensions as said first disc;

(d) said first and second discs being formed of rigid material and said third disc being of flexible material;

(e) means carrying all three of said discs in superposed, closely parallel planes with said third disc between said first and second discs including a rod passing through aligned apertures in each of said first, second and third discs and wherein said apertures are of larger cross sectional dimension than the portion of said rod upon which said disc members are carried, whereby said disc members are loosely carried by said rod to allow radial variation in the relation of said superposed planes and the axis of said rod; and (f) mounting means allowing selective movement of said carrying means between a first position, wherein said first disc is positioned within said opening and said third disc contacts said wall portion to effectively block gaseous flow through said opening, and a second position, wherein said third disc is spaced from said wall portion to permit free gaseous flow through said opening.

10. The invention according to claim 9 wherein said third disc is in physical contact, on opposite sides thereof, with said first and second discs.

11. The invention according to claim 9 wherein said mounting means comprises a pivotal support for said rod providing movement thereof between said first and second positions about an axis parallel to and laterally spaced from said disc planes.

12. The invention according to claim 9 wherein said mounting means comprises a support for said rod providing axial movement thereof between said first and second positions.

13. The invention according to claim 11 or 12 and further including spring means biasing said rod toward said first position.

14. The invention according to claim 11 or 12 and further including spring means biasing said first position toward said rod and detent means for selectively retaining said rod in said second position.

* * * * *